US005524777A

United States Patent [19]

Weber

[11] Patent Number: 5,524,777

[45] Date of Patent: Jun. 11, 1996

[54] LIFTING APPARATUS FOR A TRANSFER DEVICE

[75] Inventor: Reinhard Weber, Jever, Germany

[73] Assignee: Fried. Krupp AG Hoesch-Krupp, Essen, Germany

[21] Appl. No.: 394,018

[22] Filed: Feb. 23, 1995

[30] Foreign Application Priority Data

Feb. 23, 1994 [DE] Germany ..... 44 05 780.6

[51] Int. Cl.[6] ..... B66C 23/72

[52] U.S. Cl. ..... 212/178; 212/195

[58] Field of Search ..... 212/178, 195, 212/196; 414/719

[56] References Cited

U.S. PATENT DOCUMENTS

| | | | |
|---|---|---|---|
| 3,891,095 | 6/1975 | Symmank | 212/178 |
| 4,363,412 | 12/1982 | Patel et al. | 212/178 |
| 5,199,583 | 4/1993 | Weider et al. | 212/156 |

FOREIGN PATENT DOCUMENTS

| | | |
|---|---|---|
| 2142750 | 4/1973 | Germany . |
| 3912868 | 8/1990 | Germany . |
| 4124173 | 1/1993 | Germany . |

*Primary Examiner*—David A. Bucci

*Assistant Examiner*—Thomas J. Brahan

*Attorney, Agent, or Firm*—Spencer & Frank

[57] ABSTRACT

A lifting apparatus mountable on a rotatable platform for transferring counterweights. The lifting apparatus includes a lifting element having an upper, stationary cage, and a lower cage rotatable relative to the upper cage, each being composed of a tube having a rectangular cross-section. A ball bearing slewing gear connects the lower cage to the upper cage, and has an upper part forming a base plate of the upper cage rigidly connectable to the rotatable platform. A vertically-extendable double-acting counterweight-lifting cylinder is positioned within the upper and the lower cages. A rectangular bar guide is secured to an upper end of the counterweight-lifting cylinder, and is slidingly guided within the upper and the lower cages. A cross-pin is fastened to a lower end of the counterweight-lifting cylinder and projects through an outer surface of the counterweight-lifting cylinder perpendicular from a longitudinal axis of the counter-weight lifting cylinder to form a form-fitting connection with a respective one of the counterweights when the lower cage is rotated. Also provided is an operating cylinder having a displaceable piston rod having a displaceable end. The operating cylinder has opposite ends, one of which is constituted by the displaceable end of the piston rod. One end of the operating cylinder rod is securable to the rotatable platform. The other end of the operating cylinder is hinged to the lower cage so that an extension of the piston rod causes the rotation of the lower, rotatable cage.

4 Claims, 4 Drawing Sheets

LIFTING APPARATUS FOR A TRANSFER DEVICE

CROSS-REFERENCE TO RELATED APPLICATIONS

This application claims the priority of application Ser. No. P 44 05 780.6, filed in Germany on Feb. 23, 1994, which is incorporated herein by reference.

BACKGROUND OF THE INVENTION

The present invention relates to a transfer device for counterweights having openings therethrough, such as used on jib cranes, and in particular, mobile telescopic cranes. The transfer device has a lifting apparatus comprising a rotatable platform, two lifting elements and a rotatable upper crane part. The lifting elements are each provided with a vertically-extending member (piston rod) that causes the lower end of a lifting cylinder to be insertable into the openings of the counterweights and to be connectable thereto using a rotational movement.

In the known lifting apparatuses of the above type, such as disclosed in German patents DE 39 12 868 C1 and DE 41 24 173 A1, complicated pivoting gears, and racks, pinions or the like are required to rotate the vertically-extending member to produce the connection with the counterweights, because for lifting, the piston rod is typically inserted through the openings of the counterweights. These gears result in higher production costs, and are very susceptible to breakdowns.

SUMMARY OF THE INVENTION

It is an object of the present invention to provide a lifting apparatus for a transfer device of the aforementioned type, and that can be produced cost-effectively, is technologically simple, and offers maximum reliability.

The above object is accomplished according to the invention by the provision of a lifting apparatus mountable to a rotatable platform of a jib crane for transferring counterweights having openings therethrough, the lifting apparatus comprising: at least one lifting element, comprising: an upper, stationary cage; a lower cage rotatable relative to the upper cage, the upper cage and the lower cage each comprising a tube having a rectangular cross section; a ball bearing slewing gear connecting the lower cage to the upper cage, an upper part of the ball bearing slewing gear forming a base plate of the upper cage and being rigidly connectable to the rotatable platform; a vertically-extendable, double-acting counterweight-lifting cylinder having an upper end and a lower end, the counterweight-lifting cylinder being slidably positioned within the upper and the lower cages and rotatable into respective locked and unlocked positions; a rectangular bar guide secured to the upper end of the counterweight-lifting cylinder and being slidingly guided within the upper and the lower cages; a cross-pin fastened to the lower end of the counterweight-lifting cylinder and projecting from an outer surface of the counterweight-lifting cylinder perpendicularly from a longitudinal axis of the counterweight-lifting cylinder to form a form-fitting connection with the counterweights when the counterweight-lifting cylinder is rotated into the locked position; and an operating cylinder including a displaceable piston rod having a displaceable end, the operating cylinder having opposite ends, one of which is constituted by the displaceable end of the piston rod, one opposite end of the operating cylinder being securable to the rotatable platform and the other opposite end of the operating cylinder being hinged to the lower, rotatable cage; wherein when the lower end of the counterweight-lifting cylinder is extended through an opening of a respective counterweight, the rectangular bar guide is located within the lower rotatable cage so that displacement of the piston rod rotates the lower cage which in turn rotates the counterweight-lifting cylinder between the locked and unlocked positions.

The lifting apparatus according to the invention is particularly reliable because the counterweight-lifting cylinder is only rotatable in its extended position, that is, when the rectangular bar guide secured to the upper end of the counterweight-lifting cylinder is located inside the lower, rotatable cage. Thus, as the lower cage rotates, the rectangular bar guide located therein likewise rotates, causing the counterweight-lifting cylinder to rotate. However, as long as the rectangular bar guide is located in the upper, stationary cage, rotation of the counterweight-lifting cylinder is impossible. This fully precludes operating errors.

In the lifting apparatus of the present invention, the same work processes are utilized as in the known lifting apparatuses, i.e., the lifting and the placement of the counterweights. However, the previously known manual lifting apparatuses required that the crane operator leave the crane cabin on the upper crane part to control and monitor the work processes. The present invention solves this problem by preferably providing a concentrically disposed, inductive path length sensor inside each lifting element. The head of the piston rod of each lifting element, located in the upper, stationary cage, is provided with a bore, through which the cable of the, for example, inductive path length sensor is guided. The lifting apparatus can therefore be monitored electronically, and the crane operator no longer needs to leave the crane cabin on the upper crane part to control and monitor the work processes; instead, the work processes can be controlled from the instrument panel, to which the cable of the inductive path length sensor is lead. The inductive path length sensor continuously indicates the current lifting status of the lifting element to the crane operator on the instrument panel. Thus, the crane operator can lift the counterweights into a crane operating position, and place the counterweights into a crane driving position, from the crane cabin.

It is also useful to have information about the position of the cross-pin to help determine the exact position of the lifting element. Thus, in a preferred embodiment of the invention, two electrical switches are located on the base plate of the upper, stationary cage of each lifting element. The electrical switches detect the rotational positioning of the cross-pin, and transmit a signal in accordance thereto to the instrument panel. The signals "open" (to indicate the pin is not engaged with the counterweights) and "locked" (to indicate the pin is engaged with the counterweights) are displayed on the instrument panel via these electrical switches.

In a further aspect of the invention, the upper head of the piston rod of the lifting element is provided with bores. Oil is supplied to the piston surface and the annular surface of the lifting elements through the bores. Because of this type of cylinder suspension, the piston rod is protected against damage and is maintenance-free, particularly if it is machined as is the conventional practice.

Because the take-up of the counterweights is exactly reverse to their placement, the lifting apparatus is particularly simple to operate.

Both individual and multiple counterweights can be lifted simultaneously with the lifting apparatus of the invention.

The invention will be described below in greater detail in connection with embodiments thereof that are illustrated in the drawing figures.

DETAILED DESCRIPTION OF THE INVENTION

Figure 1:
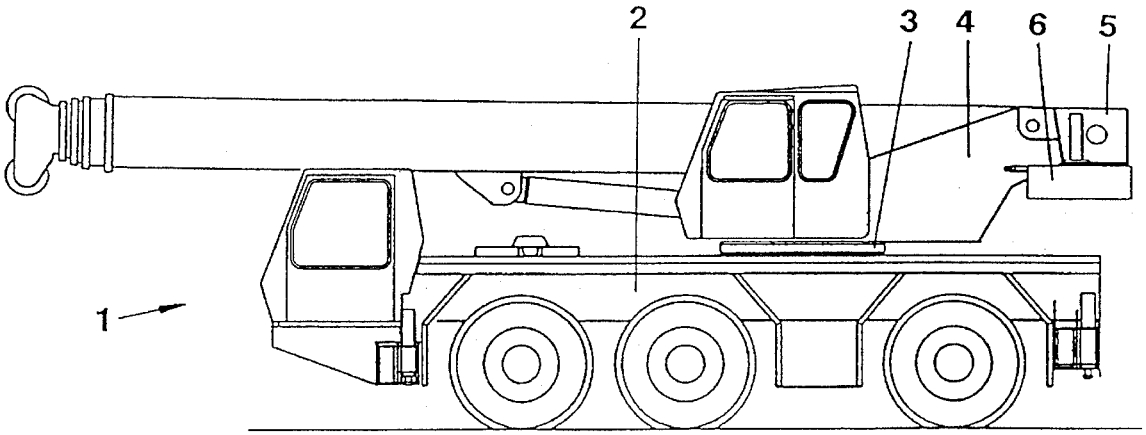
FIG. 1 is a side view of a jib crane in the driving position, with counterweights.

Referring to FIG. 1, a jib crane 1 is illustrated. Jib crane 1 comprises a chassis 2, a rotating joint 3, and a rotatable upper crane part 4. Chassis 2 is connected to rotatable upper crane part 4 by rotating joint 3. A lifting apparatus 5, which supports the counterweights 6, is secured to the upper crane part 4.

Figure 2:
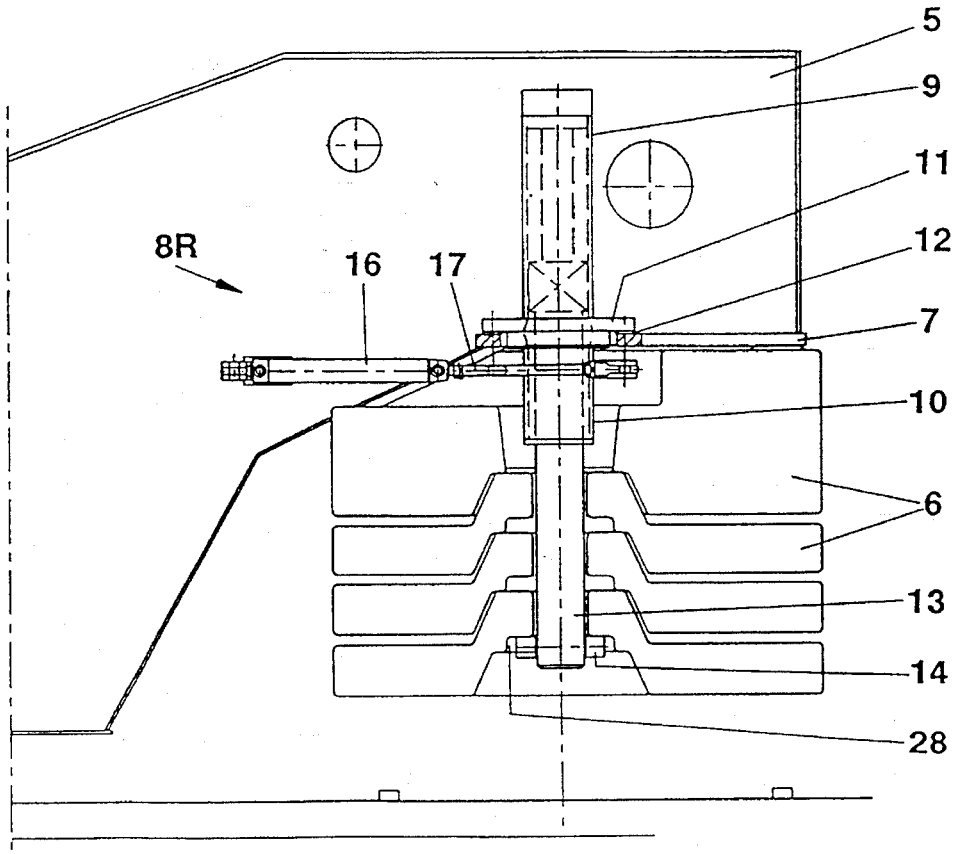
FIG. 2 is a sectional, longitudinal view of the crane, as seen through the lifting apparatus of the jib crane illustrated in FIG. 1, with the lifting apparatus being on the right in the driving direction and being illustrated in the locked position.
Figure 3:
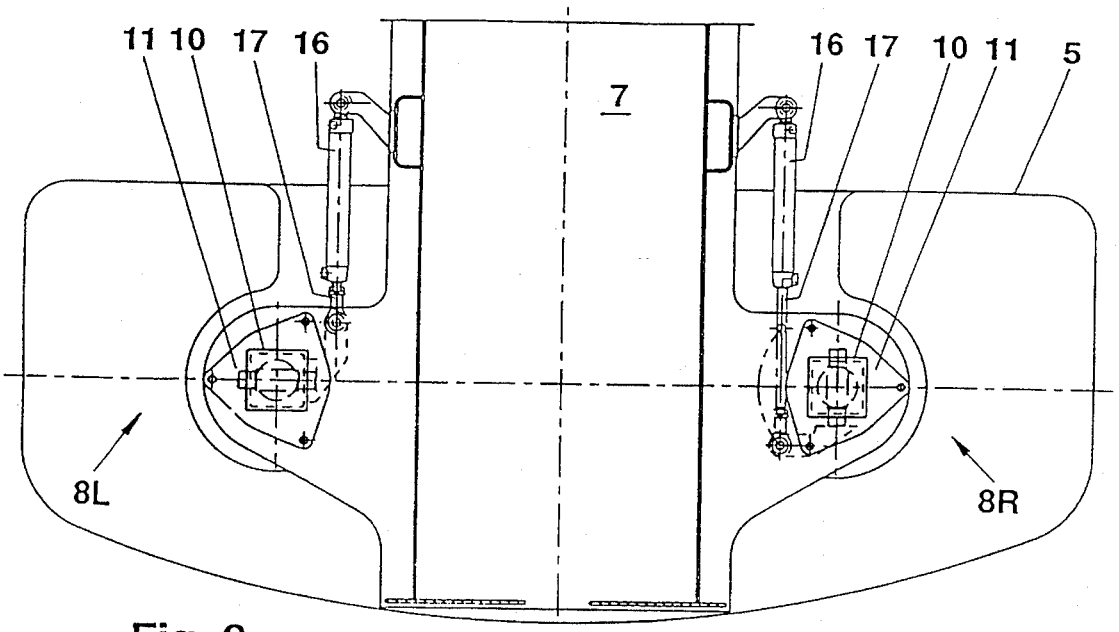
FIG. 3 is a top view of the counterweights and the lifting apparatus illustrated in FIG. 2 rotated by 90°, with the lifting element in the left half of the drawing being illustrated in the unlocked position and the lifting element in the right half of the drawing being illustrated in the locked position.
Figure 4:
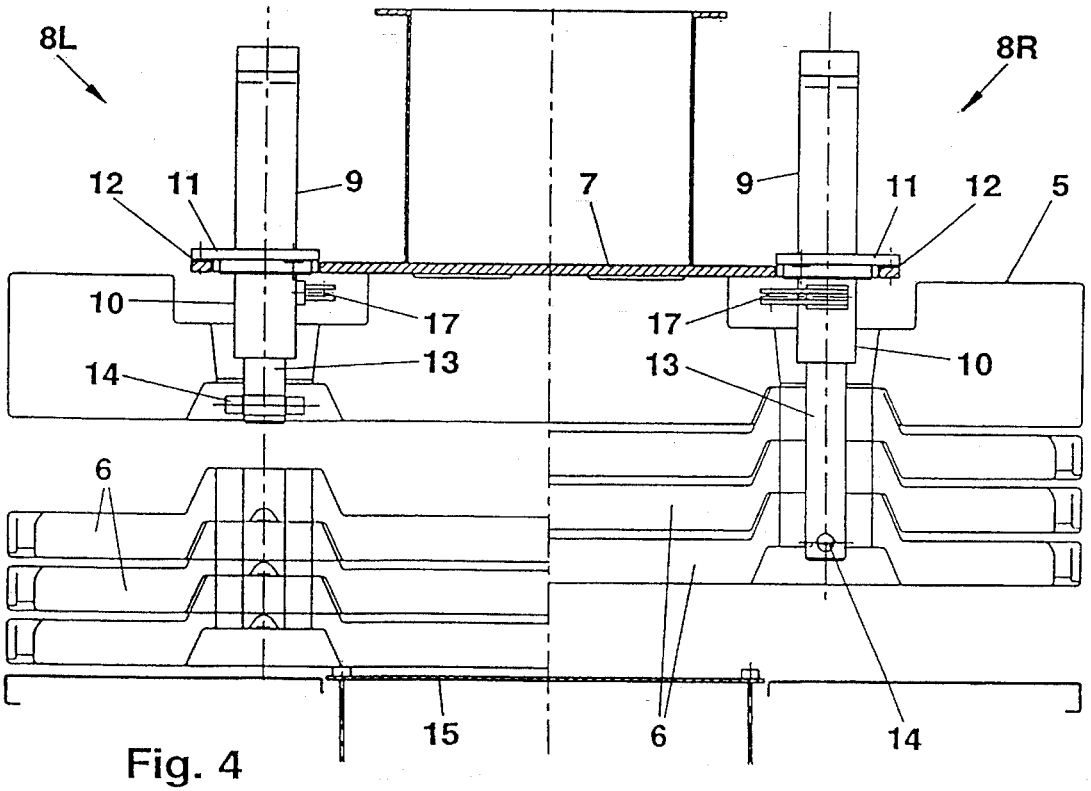
FIG. 4 is a cross-sectional illustration of the lifting apparatus illustrated in FIGS. 2 and 3, likewise with the lifting apparatus in the left half of the drawing being illustrated in the unlocked position and the lifting element in the right half of the drawing being illustrated in the locked position.

As illustrated in FIGS. 2 through 4, lifting apparatus 5, which is mounted on a rotatable platform 7, comprises two lifting elements 8R and 8L, each of which has an upper, stationary cage 9 and a lower, rotatable cage 10. Upper cage 9 is permanently secured to rotatable platform 7 by a base plate 11, which forms the upper part of a ball bearing slewing gear 12. Lower cage 10 is rotatable relative to the upper cage. A double-acting counterweight-lifting cylinder 13 is movable and guided within cages 9 and 10. A cross-pin 14 is inserted into a lower end of counterweight-lifting cylinder 13 perpendicular to an axis thereto, so that the cross-pin projects from both sides of the counterweight-lifting cylinder.

Lifting element 8R is shown in FIG. 2 and the right halves of FIGS. 3 and 4 in a position with the lifting apparatus being locked, and counterweights 6 taken up by lifting element 8R. Lifting element 8L as shown in the left halves of FIGS. 3 and 4 is in a position with the lifting apparatus being unlocked, and counterweights 6 laid on top of a chassis frame 15 (see FIG. 4, left half).

Lifting elements 8R and 8L are each provided with an operating cylinder 16. Operating cylinder 16 has a piston rod 17 hinged to the lower, rotatable cage 10. The rear end of operating cylinder 16 is connected to rotatable platform 7 using a pin 16'.

Figure 5:
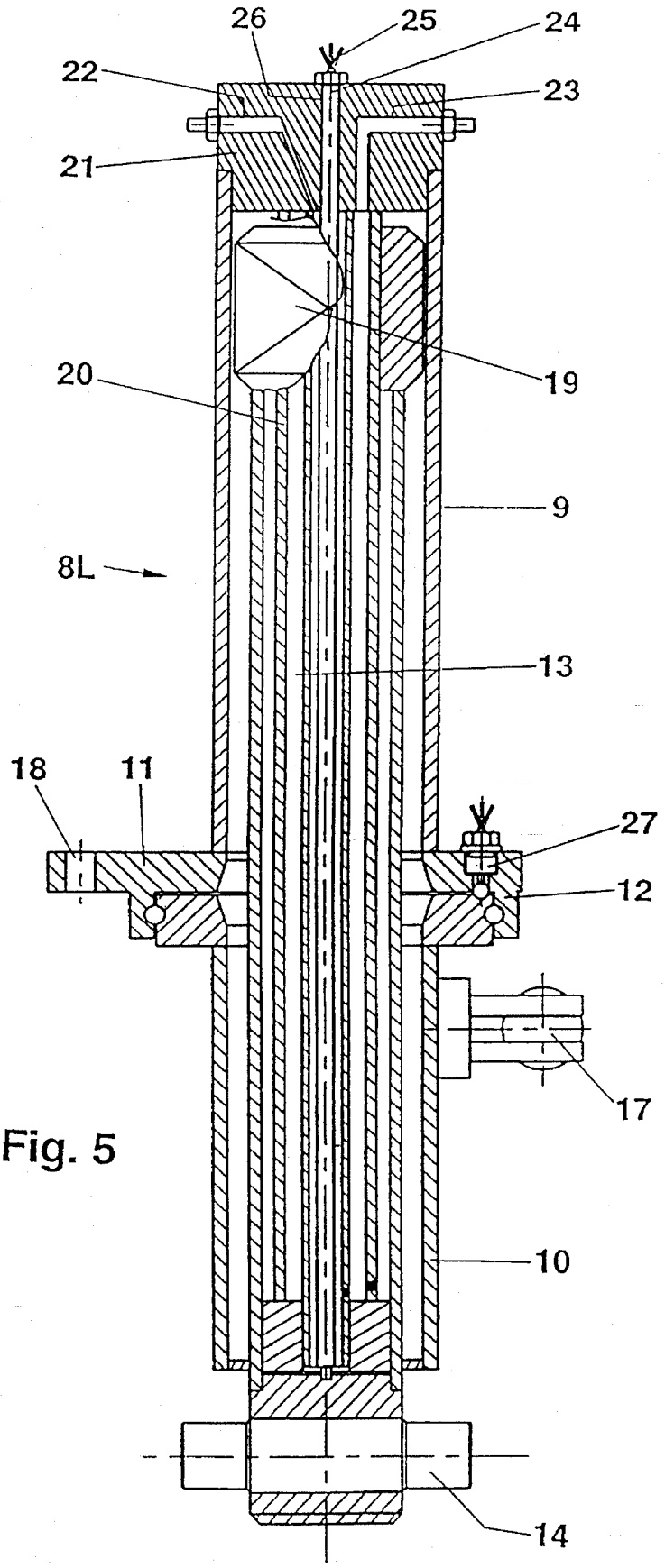
FIG. 5 is an enlarged longitudinal sectional view of a lifting apparatus.

FIG. 5 shows a lifting element 8L, which comprises upper, stationary cage 9, lower, rotatable cage 10 and counterweight-lifting cylinder 13, which is guided therein.

Cages 9 and 10 have a rectangular cross-section, and are connected to one another by ball bearing slewing gear 12. The upper part of ball bearing slewing gear 12 forms the base plate 11 of the upper, stationary cage 9, and is connected to rotatable platform 7. To connect base plate 11 with rotatable platform 7 (FIGS. 2 through 4), typically bores 18 are provided through base plate 11 for accommodating bolts (not shown).

At its upper end, counterweight-lifting cylinder 13 includes a rectangular bar guide 19 secured thereto. Rectangular bar guide 19 is guided so as to glide within the rectangular interior of cages 9 and 10 (see FIG. 6).

Each lifting element has a piston rod 20 having a piston rod head 21 located in the upper, stationary cage. Piston rod head 21 is provided with bores 22 and 23. Bore 22 allows for the supply of oil to the piston surface of lifting element 8L, and bore 23 allows oil to be supplied to the annular surface of lifting element 8L.

A concentrically arranged, e.g. inductive path length sensor 24 is disposed inside lifting element 8L. Sensor 24 has a cable 25 guided out of lifting element 8L through a bore 26 provided in piston rod head 21. The, for example, inductive path length sensor allows the lifting apparatus to be monitored electronically, so that the crane operator no longer needs to leave the crane cabin on the upper crane part to control the work processes; instead, the work processes can be controlled from the instrument panel, to which the cable of the inductive path length sensor is lead. The inductive path length sensor 24 continuously indicates the current lifting status of the lifting element to the crane operator on the instrument panel. Thus, the crane operator can lift the counterweights into a crane operating position, and place the counterweights into a crane driving position, from the crane cabin.

Preferably, electrical switches 27 are disposed on base plate 11 of upper cage 9, which are operated mechanically by a sliding member in the lower base plate of rotatable cage 10. Electrical switches 27 detect the rotational positioning of the cross-pin, and, through the opened or closed positioning of the switch, transmit a signal to the instrument panel. The signals "open" (to indicate the pin is not engaged with the counterweights) and "locked" (to indicate the pin is engaged with the counterweights) are displayed on the instrument panel via these electrical switches.

As counterweight-lifting cylinder 13 is lowered, rectangular bar guide 19 slides downward along the rectangular interior of the upper, stationary cage 9, and finally enters the rectangular interior of the lower, rotatable cage 10. Once rectangular bar guide 19 is located completely inside the rectangular interior of rotatable cage 10, cross-pin 14 will have moved through the openings of counterweights 6. At the end of the stroke, the cross-pin will be located inside a hollow space 28 (FIG. 2) that is provided in counterweights 6. Hollow space 28 also serves to center counterweights 6 relative to each other. Next, piston rod 17 of operating cylinder 16 effects a piston stroke, causing lower cage 10 to rotate. This causes a simultaneous rotation of rectangular bar guide 19 and counterweight-lifting cylinder 13, so that cross-pin 14 is rotated into the locked position, thus producing a form-fitting connection with counterweights 6 in the lifting direction (FIG. 2).

Figure 7:
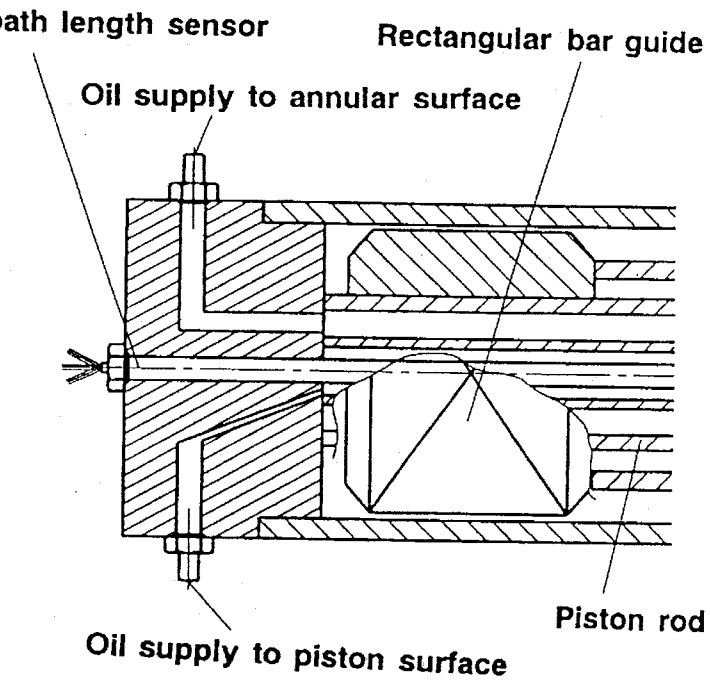
FIG. 7 is an enlarged view of the upper cage and enclosed inductive path length sensor.
Figure 6:
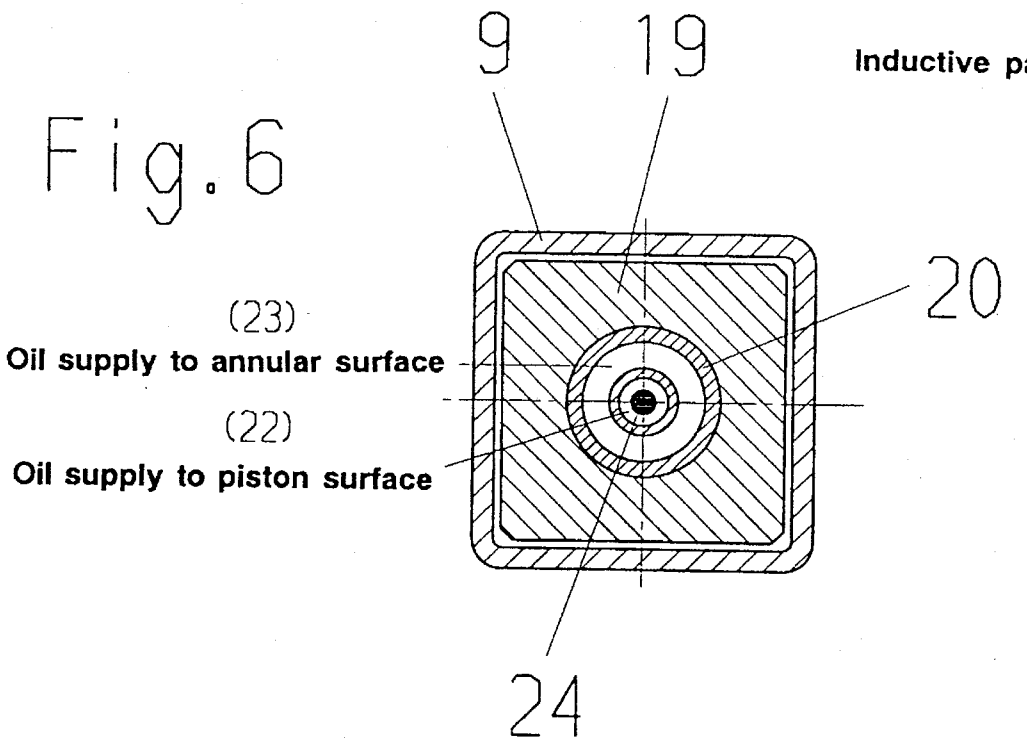
FIG. 6 illustrates the lifting apparatus in cross-section, in particular the cylinder cage and the rectangular bar guide of the lifting cylinder.

FIG. 6 shows a section of lifting element 8L at the location of the upper rectangular bar guide 19 of lifting element 8L. FIG. 7 shows upper cage 9 and piston rod 20 with, for example, enclosed inductive path length sensor 24.

The invention now being fully described, it will be apparent to one of ordinary skill in the art that any changes and modifications can be made thereto without departing from the spirit or scope of the invention as set forth herein.

What is claimed is:

1. A lifting apparatus mountable on a rotatable platform of a jib crane for transferring counterweights having openings therethrough, the lifting apparatus comprising:

at least one lifting element, comprising:

an upper, stationary cage;

a lower cage rotatable relative to said upper cage, said upper cage and said lower cage each comprising a tube having a rectangular cross section;

a ball bearing slewing gear connecting said lower cage to said upper cage, an upper part of said ball bearing slewing gear forming a base plate of the upper cage and being rigidly connectable to the rotatable platform;

a vertically-extendable, double-acting counterweight-lifting cylinder having an upper end and a lower end, said counterweight-lifting cylinder being slidably positioned within said upper and said lower cages and rotatable into respective locked and unlocked positions;

a rectangular bar guide secured to the upper end of said counterweight-lifting cylinder and being slidingly guided within said upper and said lower cages;

a cross-pin fastened to the lower end of said counterweight-lifting cylinder and projecting from an outer surface of said counterweight-lifting cylinder perpendicularly from a longitudinal axis of said counterweight-lifting cylinder to form a form-fitting connection with the counterweights when said counterweight-lifting cylinder is rotated into the locked position; and an operating cylinder including a displaceable piston rod having a displaceable end, said operating cylinder having opposite ends, one of which is constituted by the displaceable end of the piston rod, one opposite end of said operating cylinder being securable to the rotatable platform and the other opposite end of said operating cylinder being hinged to said lower, rotatable cage;

wherein when the lower end of the counterweight-lifting cylinder is extended through an opening of a respective counterweight, said rectangular bar guide is located within the lower rotatable cage so that displacement of said piston rod rotates said lower cage which in turn rotates the counterweight-lifting cylinder between the locked and unlocked positions.

2. The lifting apparatus as defined in claim 1, wherein said upper, stationary cage has a piston rod head having a bore therethrough, and further comprising a concentrically disposed, inductive path length sensor provided within said lifting element, and a cable guided through said bore connected to said inductive path length sensor.

3. The lifting apparatus as defined in claim 2, further comprising at least one electrical switch disposed on the base plate of said upper cage and being activatable by the rotational movement of said lower cage for indicating said locked and unlocked positions.

4. A lifting apparatus as defined in claim 1, wherein said upper, stationary cage has a piston rod head having a plurality of bores therethrough for supplying oil to the piston surface and the annular surface of the lifting element.

* * * * *